US008388303B2

(12) United States Patent
Weidmann et al.

(10) Patent No.: US 8,388,303 B2
(45) Date of Patent: Mar. 5, 2013

(54) GAS TURBINE HAVING A ROTOR INCLUDING A TURBINE ROTOR, EXPANDED SHAFT AND A COMPRESSOR ROTOR

(75) Inventors: Wilfried Weidmann, Erdweg (DE); Moritz Wirth, Berlin (DE)

(73) Assignee: MTU Aero Engines GmbH, Munich (DE)

( * ) Notice: Subject to any disclaimer, the term of this patent is extended or adjusted under 35 U.S.C. 154(b) by 629 days.

(21) Appl. No.: 12/451,511

(22) PCT Filed: May 2, 2008

(86) PCT No.: PCT/DE2008/000758
§ 371 (c)(1),
(2), (4) Date: Nov. 16, 2009

(87) PCT Pub. No.: WO2008/141609
PCT Pub. Date: Nov. 27, 2008

(65) Prior Publication Data

US 2010/0104418 A1 Apr. 29, 2010

(30) Foreign Application Priority Data

May 18, 2007 (DE) ..... 10 2007 023 380

(51) Int. Cl.
*F01D 11/04* (2006.01)

(52) U.S. Cl. ..... 415/111; 415/112; 415/115; 416/174

(58) Field of Classification Search ..... 415/65, 415/68, 111, 112, 115, 116; 416/124, 174
See application file for complete search history.

(56) References Cited

U.S. PATENT DOCUMENTS

| | | | | |
|---|---|---|---|---|
| 2,680,001 | A | 6/1954 | Batt | 253/39.15 |
| 3,844,110 | A * | 10/1974 | Widlansky et al. | 60/39.08 |
| 4,296,599 | A * | 10/1981 | Adamson | 60/39.23 |
| 5,472,313 | A * | 12/1995 | Quinones et al. | 415/115 |
| 6,976,679 | B2 * | 12/2005 | Goss et al. | 277/347 |
| 7,828,513 | B2 * | 11/2010 | Durocher et al. | 415/111 |
| 2005/0089399 | A1 | 4/2005 | Bart et al. | 415/170.1 |
| 2007/0137221 | A1 * | 6/2007 | Charier et al. | 60/806 |

* cited by examiner

FOREIGN PATENT DOCUMENTS

| | | |
|---|---|---|
| CA | 995 014 | 8/1976 |
| EP | 1 785 588 | 5/2007 |

OTHER PUBLICATIONS

Search Report of PCT/DE2008/000758 (6 pages), Apr. 7, 2009.

*Primary Examiner* — Christopher Verdier
*Assistant Examiner* — Andrew C Knopp
(74) *Attorney, Agent, or Firm* — Davidson, Davidson & Kappel, LLC

(57) ABSTRACT

A gas turbine having a rotor which includes a turbine rotor, a shaft and a compressor rotor, the turbine rotor having at least one rotor disk and a rotor cone leading from the or a rotor disk to the shaft, the downstream end of the shaft being rotatably supported in a bearing having a bearing chamber, the interior space of the shaft being designed as a flow channel for bearing-chamber sealing air, and the space surrounding the rotor cone upstream of the same being designed as a flow space for cooling air is disclosed. In the region of the rotor connection, the shaft exhibits an expanded portion, at whose upstream end, openings are provided to allow cooling air to enter, and, at whose downstream end, openings are provided to allow cooling air to exit into the space between the bearing chamber and the rotor cone, a wall separating the streams of the cooling air and of the sealing air in the shaft interior from one another.

19 Claims, 2 Drawing Sheets

GAS TURBINE HAVING A ROTOR INCLUDING A TURBINE ROTOR, EXPANDED SHAFT AND A COMPRESSOR ROTOR

Priority is claimed to German Patent Application DE 10 2007 023 380.0, filed May 18, 2007 through international application PCT/DE2008/000758, filed May 2, 2008, the entire disclosures of which are hereby incorporated by reference herein The present invention relates to a gas turbine having a rotor which includes a turbine rotor, a shaft and a compressor rotor and, in the case of a multi-shaft gas turbine, is part of the low-pressure system, the turbine rotor having at least one bladed rotor disk and a rotor cone leading from the or a rotor disk to the shaft, and the downstream end of the shaft being rotatably supported in a bearing having a bearing chamber, the interior space of the shaft being designed as a flow channel for sealing air that leads to the bearing chamber, and the space surrounding the rotor cone upstream of the same being designed as a flow space for the cooling air used for cooling the rotor blades.

BACKGROUND OF THE INVENTION

To fulfill the required specifications, future engine concepts call for high-speed, low-pressure turbines having high AN values, high turbine inlet temperatures and compact, short designs. To avoid hot gas ingress from the main stream, and to adjust the bearing thrust at the fixed bearing of the low-pressure system, air must be directed to the cavity between the last turbine stage and the turbine exhaust case (TEC). To optimally design this turbine disk, a thermally compensated design (avoidance of axial temperature gradients) is essential. In the case of low-pressure turbines that have been implemented in practice, this air is typically drawn off at the low-pressure compressor and routed through the low-pressure turbine shaft to the rear TEC bearing chamber. This air is used as sealing air at the bearing and for venting the rear cavity. Due to the restricted sealing air temperature (risk of oil fire, coking, etc.), the temperature of this sealing air is substantially colder than that of the cooling air which acts upon the opposite side of the rotor disk. As a result, an axial temperature gradient forms over the disk which complicates the task of providing a weight-optimized design for the rotor disk of the rotor connection. Due to the substantially inwardly drawn disk bodies required for high-speed engine concepts, and the compact design, only a very short rotor cone is possible for connection to the shaft. This reduced decay length makes the mechanical design (low-cycle fatigue lifetime) difficult. In particular, a sharp temperature gradient over the rotor cone of the shaft connection and at the corresponding disk is no longer acceptable.

The routing of the air in the case of a conventional low-pressure turbine is illustrated exemplarily in FIG. 1. Air of different temperatures acts on both sides of the cone of the rotor connection. Upstream of the shaft connection, the temperature of the rotor blade cooling air prevails; downstream of the shaft connection at the turbine exhaust case (TEC), the temperature of the bearing sealing air prevails. This results in temperature differences accompanied by high thermal stresses in the rotor cone and in the corresponding rotor disk.

SUMMARY OF THE INVENTION

In contrast, the object of the present invention is to devise a gas turbine having a rotor which includes a turbine rotor, a shaft and a compressor rotor and, in the case of a multi-shaft gas turbine, is part of the low-pressure system; a long service life being achieved by providing a thermally compensated design in the region of the turbine rotor and its shaft connection.

This objective is achieved by a gas turbine having a rotor which includes a turbine rotor, a shaft and a compressor rotor and, in the case of a multi-shaft gas turbine, is part of the low-pressure system, the turbine rotor having at least one bladed rotor disk and a rotor cone leading from the or a rotor disk to the shaft, and the downstream end of the shaft being rotatably supported in a bearing having a bearing chamber, the interior space of the shaft being designed as a flow channel for sealing air that leads to the bearing chamber, and the space surrounding the rotor cone upstream of the same being designed as a flow space for the cooling air used for cooling the rotor blades. In the region of the rotor cone connection, the shaft exhibits an expanded portion having an enlarged inside and outside diameter, at whose upstream end, openings are provided to allow cooling air to enter into the expanded interior space of the shaft, and, at whose downstream end, openings are provided to allow cooling air to exit into the space between the bearing chamber and the rotor cone. The expanded interior space of the shaft is sealed from the traversing interior space of the shaft by a wall for separating cooling air and sealing air. As a result, cooling air of approximately the same temperature acts on both sides of the rotor cone and the corresponding rotor disk, in the sense of a thermal compensation. Any small quantity of sealing air having a lower temperature that emerges from the bearing chamber and mixes with the cooling air, has no significant effect.

BRIEF DESCRIPTION OF THE DRAWINGS

The related art of the type described and the present invention are explained in further detail below with reference to the figures. In a simplified representation that is not to scale, the figures show.

DETAILED DESCRIPTION

Figure 1:
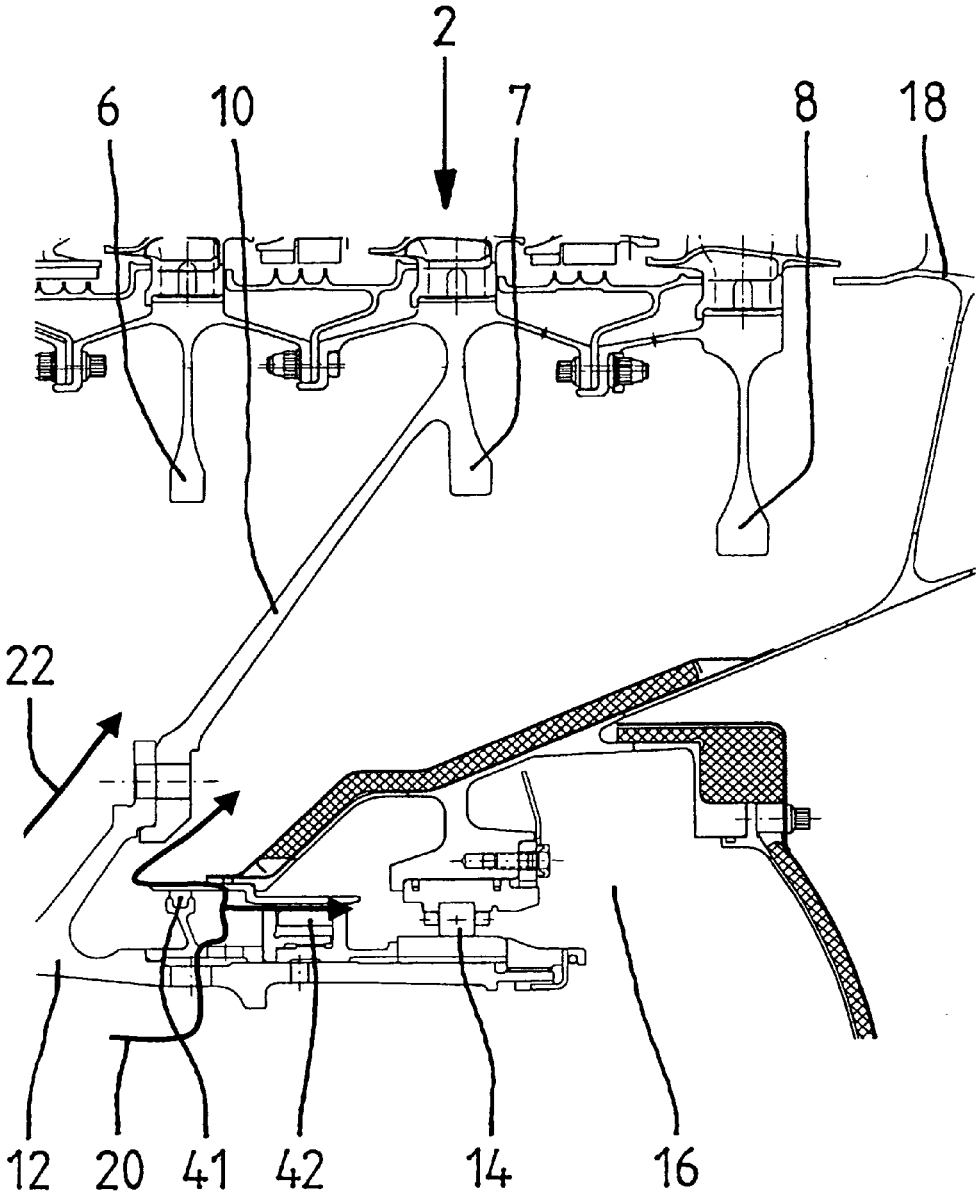
Fig.1 Prior Art
FIG. 1: a partial longitudinal section through a turbine rotor having a shaft connection and a bearing assembly, given a conventional routing of the air.

Turbine rotor 2 in FIG. 1 includes three bladed rotor disks 6, 7 and 8. From middle rotor disk 7, a rotor cone 10 leads to corresponding shaft 12 and is flanged thereto. At its downstream end, shaft 12 is rotatably supported in a bearing 14. Bearing 14 is mounted in a bearing chamber 16 which, in turn, is part of a turbine exhaust case 18. At the shaft entry, bearing chamber 16 is non-hermetically sealed by two axially spaced seals 41, 42. Cooling air 22 flows in the space radially outside of shaft 12 and upstream of rotor cone 10. It has an elevated temperature that is still suited for cooling purposes, as it is used for cooling blades in the high-temperature and high-pressure range. Sealing air 20 having a temperature that is significantly lower than that of cooling air 22 is routed through the interior of shaft 12. Sealing air 20 is drawn from shaft 12 and is directed in-between seals 41, 42 and then flows partially into bearing chamber 16, and partially into the space between turbine rotor 2 and turbine exhaust case 18. Thus, different air temperatures prevail upstream of rotor cone 10 and downstream of the same, which leads to thermal stresses and to a shortened service life of the rotor connection.

Figure 2:
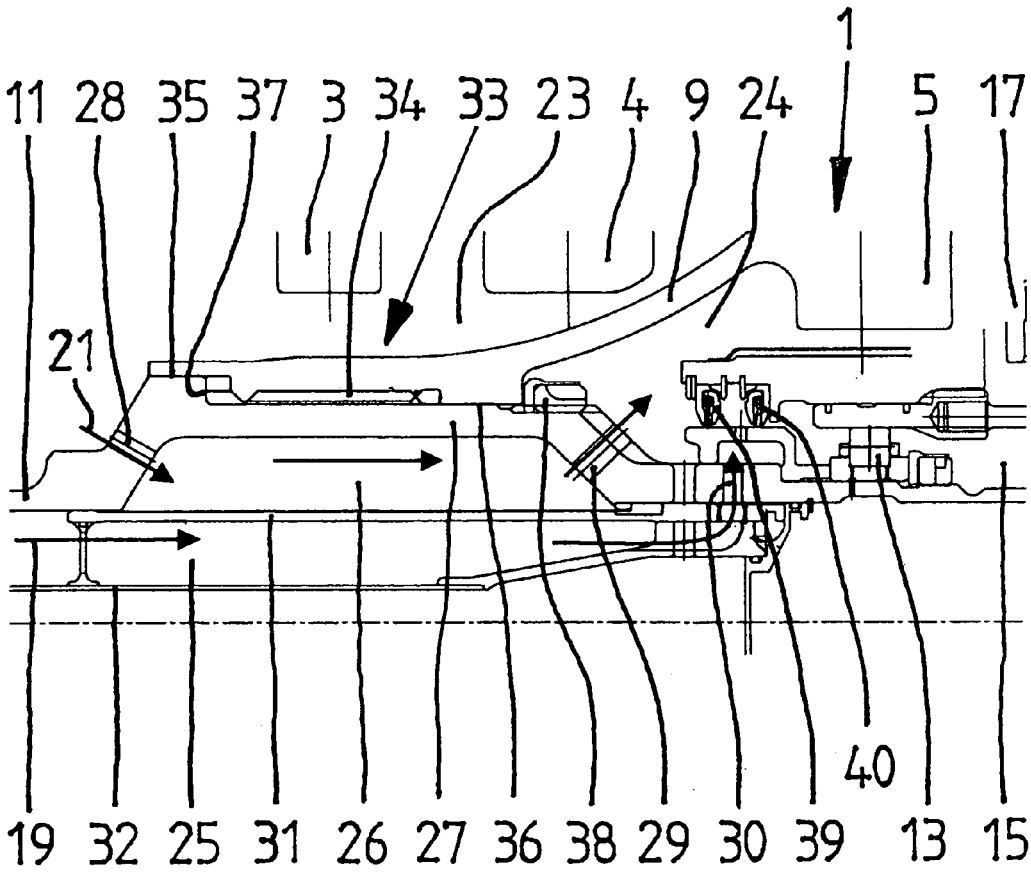
FIG. 2: a partial longitudinal section through a turbine rotor having a shaft connection and a bearing assembly, given a routing of the air in accordance with the present invention.

In contrast, the approach according to the present invention in accordance with FIG. 2 is distinguished by design modifications which lead to an altered air temperature distribution. Of turbine rotor 1, three rotor disks 3, 4 and 5 are discernible. A rotor cone 9 leading to corresponding shaft 11 is integrally joined to rearmost rotor disk 5. Rotor cone 9 is detachably connected to shaft 11. In the illustrated case, connection 33 (see arrow) is realized by a tooth system 34, two press-fit connections 35, 36, an axial stop 37, as well as a screw connection 38. In the region of connection 33, shaft 11 exhibits an expanded portion 27 having an enlarged inside and outside diameter. Cooling air 21 having an elevated temperature is located in space 23 upstream, respectively outside of rotor cone 9 and radially outside of shaft 11. On the other hand, sealing air 19 having a lower temperature flows in interior space 25 of shaft 11. Cooling air 21 may enter into the shaft interior through openings 28 at the upstream end of expanded portion 27. Through openings 29 at the downstream end of expanded portion 27, the same cooling air 21 may emerge again from the shaft interior and enter into space 24 downstream of rotor cone 9. A separating wall 31, here in the form of a shaft insert, is installed in the shaft interior to ensure that sealing air 19 and cooling air 21 do not mix. Thus, annular interior space 26 located between wall 31 and expanded portion 27 is only in direct communication with spaces 23 and 24. In the illustrated case, the stream of sealing air 19 is concentrated by a central pipe 32 at the periphery of interior space 25, which is not absolutely necessary. Sealing air 19 is drawn in a generally known manner out of the shaft via openings 30 and is directed in-between two axially spaced seals 39, 40, here in the form of brush seals. From there, a portion of sealing air 19 reaches the interior of bearing chamber 15 of bearing 13. The other portion of sealing air 19 enters via non-hermetic seal 39 into space 24 and mixes there with cooling air 21. Since the cooling air stream emerging from openings 29 is substantially larger in volume than the sealing air stream emerging from seal 39, the resulting mixing temperature in space 24 deviates only insignificantly from the initial temperature of cooling air 21. As a result, approximately the same temperature prevails on both sides of rotor cone 9, connection 33, as well as of rotor disk 5. Thus, thermal stresses in the rotor connection according to the present invention are reduced to a minimum; in comparison to the known approaches, the service life is substantially prolonged. The mechanically highly critical rotor cone 9 may be designed without cutouts, bores, etc. In contrast, openings 28 and 29 in the area of stable expanded portion 27 of shaft 11 are uncritical.

Finally, it should also be mentioned that turbine exhaust case 17 is only schematically hinted at in FIG. 2.

What is claimed is:

1. A gas turbine comprising:

a rotor including a turbine rotor, a shaft and a compressor rotor, the turbine rotor having at least one bladed rotor disk and a rotor cone leading from the at least one rotor disk to the shaft, a downstream end of the shaft being rotatably supported in a bearing having a bearing chamber, an interior space of the shaft being designed as a flow channel for sealing air leading to the bearing chamber, and a space surrounding the rotor cone upstream of the rotor cone being designed as a flow space for cooling air used for cooling the rotor blades, wherein, in a region of a connection of the rotor cone, the shaft has an expanded portion having an enlarged inside and outside diameter, and at an upstream end of the expanded portion, openings are provided to allow the cooling air to enter into an expanded interior space of the shaft and, at a downstream end of the expanded portion, other openings are provided to allow the cooling air to exit into a further space between the bearing chamber and the rotor cone, the expanded interior space being sealed from the a further interior space of the shaft by a wall for separating the cooling air and the sealing air, wherein the expanded portion is integrally formed with the downstream end of the shaft.

2. The gas turbine as recited in claim 1 wherein the bearing chamber is part of a turbine exhaust case configured downstream of the turbine rotor.

3. The gas turbine as recited in claim 1 further comprising a pipe forming an annular flow channel for the sealing air and configured coaxially at a radial distance in the interior space of the shaft.

4. The gas turbine as recited in claim 1 wherein the flow channel for the sealing air leads through further openings in the shaft radially outwardly between two axially spaced, non-hermetic seals to the bearing chamber.

5. The gas turbine as recited in claim 4 wherein the seals are in the form of brush seals.

6. The gas turbine as recited in claim 1 wherein the rotor cone is attached at the expanded portion of the shaft via a tooth system engaging circumferentially with form locking, via press-fit connections configured axially on both sides of the tooth system, via an axial stop, as well as via an axially acting screw connection.

7. The gas turbine as recited in claim 1 wherein the gas turbine is a multi-shaft gas turbine and part of a low-pressure system.

8. The gas turbine as recited in claim 1 wherein the rotor cone increases in radius in a downstream direction.

9. The gas turbine as recited in claim 1 wherein the bearing is radially exterior with respect to the shaft at an axial location of the bearing.

10. The gas turbine as recited in claim 1 wherein the shaft rotates with the bladed rotor disk.

11. The gas turbine as recited in claim 10 wherein the rotor cone is connected to the shaft via a toothed connection.

12. The gas turbine as recited in claim 10 wherein a connection between the rotor cone and the shaft includes two press fit connections and a tooth system.

13. The gas turbine as recited in claim 12 wherein the connection further includes an axial stop and a screw connection.

14. The gas turbine as recited in claim 10 wherein the bladed rotor disk is integral with the rotor cone.

15. The gas turbine as recited in claim 1 wherein the at least one least one bladed rotor disk includes a plurality of bladed rotor disks and the rotor cone is connected to a furthest downstream of the plurality of bladed rotor disks.

16. The gas turbine as recited in claim 1 wherein the sealing air and cooling air so not mix within the shaft.

17. The gas turbine as recited in claim 1 wherein the sealing air has a temperature lower than the cooling air.

18. The gas turbine as recited in claim 1 wherein the shaft has a central pipe.

19. A gas turbine comprising:

a rotor including a turbine rotor, a shaft rotating with the turbine rotor and a compressor rotor, the turbine rotor having at least one bladed rotor disk and a rotor cone leading from the at least one rotor disk to the shaft, a downstream end of the shaft being rotatably supported on an outside surface in a bearing having a bearing chamber, an interior space of the shaft being designed as a flow channel for sealing air leading to the bearing chamber, and a space surrounding the rotor cone upstream of the rotor cone being designed as a flow space for cooling air used for cooling the rotor blades, wherein, in a region of a connection of the rotor cone, the shaft has an expanded portion having an enlarged inside and outside diameter, and at an upstream end of the expanded portion, openings are provided to allow the cooling air to enter into an expanded interior space of the shaft, and, at a downstream end of the expanded portion, other openings are provided to allow the cooling air to exit into a further space between the bearing chamber and the rotor cone, the expanded interior space being sealed from a further interior space of the shaft by a wall for separating the cooling air and the sealing air, wherein the expanded portion is integrally formed with the downstream end of the shaft.

* * * * *